US006992579B2

(12) United States Patent
Lee

(10) Patent No.: US 6,992,579 B2
(45) Date of Patent: Jan. 31, 2006

(54) BURGLAR ALARM SYSTEM HAVING REDUCED WIRING

(75) Inventor: John Kam Ho Lee, Hong Kong (CN)

(73) Assignee: Leeds Electronic Eng. Ltd., Wong Chuk Hang (HK)

( * ) Notice: Subject to any disclaimer, the term of this patent is extended or adjusted under 35 U.S.C. 154(b) by 84 days.

(21) Appl. No.: 10/748,575

(22) Filed: Dec. 30, 2003

(65) Prior Publication Data

US 2004/0155769 A1 Aug. 12, 2004

(30) Foreign Application Priority Data

Jan. 3, 2003 (GB) ..... 0300097

(51) Int. Cl.
*G08B 1/00* (2006.01)

(52) U.S. Cl. ..... 340/531; 340/533; 340/538; 340/538.17

(58) Field of Classification Search ..... 340/500, 340/502, 508, 509, 511, 522, 635, 657, 660, 340/661, 662, 663, 664, 531, 533, 538, 538.17
See application file for complete search history.

(56) References Cited

U.S. PATENT DOCUMENTS 4,360,905 A * 11/1982 Hackett ..... 367/94
5,049,860 A * 9/1991 Farrell et al. ..... 340/610
5,138,562 A * 8/1992 Shaw et al. ..... 340/577

* cited by examiner

*Primary Examiner*—Van T. Trieu
(74) *Attorney, Agent, or Firm*—Alix, Yale & Ristas, LLP

(57) ABSTRACT

Normal hard-wired domestic burglar alarms have cables with six conductors extending between the alarm controller and each remote input/output device (such as an entry keypad). The present alarm system has an alarm controller, a remote input/output device, a cable extending from the alarm controller to the remote input/output device, the cable comprising two conductors only, providing power to the remote input/output device. A signal processor at the controller monitors and processes voltage and current in the conductors to affect functions of the alarm system. A mixer at the remote input/output device processes voltage and current in the conductors to affect functions of the alarm system.

3 Claims, 4 Drawing Sheets

BURGLAR ALARM SYSTEM HAVING REDUCED WIRING

FIELD OF THE INVENTION

Normal hard-wired burglar alarm systems for domestic and commercial applications include a number of event sensors situated around a space to be monitored, each in communication with a central controller. Some installations have a central controller communicating with a number of remote control panels or keypads—one at each main entry to the premises. Such alarm systems also employ a siren sounder/bell box, usually attached in a prominent out-of-reach position at the front of the premises. For example, some such boxes employ a flashing strobe light and are mounted beneath the eaves at the front of a house.

Ordinarily, a cable having six or more internal conductors extends between the central controller and the siren sounder/bell box, and between the central controller and each remote control panel/keypad. One pair of conductors provides electrical power to the bell box or keypad, another pair of conductors provides a tamper circuit and the other pair of conductors is for signal transmission.

OBJECTS OF THE INVENTION

It is an object of the present invention to reduce the required number of conductors between an alarm central controller and a bell box and/or a remote control panel.

DISCLOSURE OF THE INVENTION

There is disclosed herein an alarm system comprising:

an alarm controller, a remote input/output device, a cable extending from the alarm controller to the remote input/output device, the cable comprising two conductors providing power to the remote input/output device, and a signal processor at the controller monitoring and processing voltage and current fluctuations in the conductors and controlling functions of the alarm system.

Preferably be alarm system further comprises a mixer at the remote input/output device operative to affect current and voltage at the two conductors.

Preferably the signal processor monitors for predefined voltage and current levels at the two conductors.

Preferably the mixer applies predefined voltage and current levels at the two conductors.

DEFINITION

As used herein, the phrase "remote input/output device" is intended to encompass entry panels such as keypads, or other input devices such as card readers, iris scanners or fingerprint scanners for example, as well as visible/audible devices such as a flashing light, strobe light, siren sounder, or bell box.

BRIEF DESCRIPTION OF THE DRAWINGS

A preferred form of the present invention will now be describe by way of example with reference to the accompanying drawings, wherein.

DESCRIPTION OF THE PREFERRED EMBODIMENT

Figure 1:
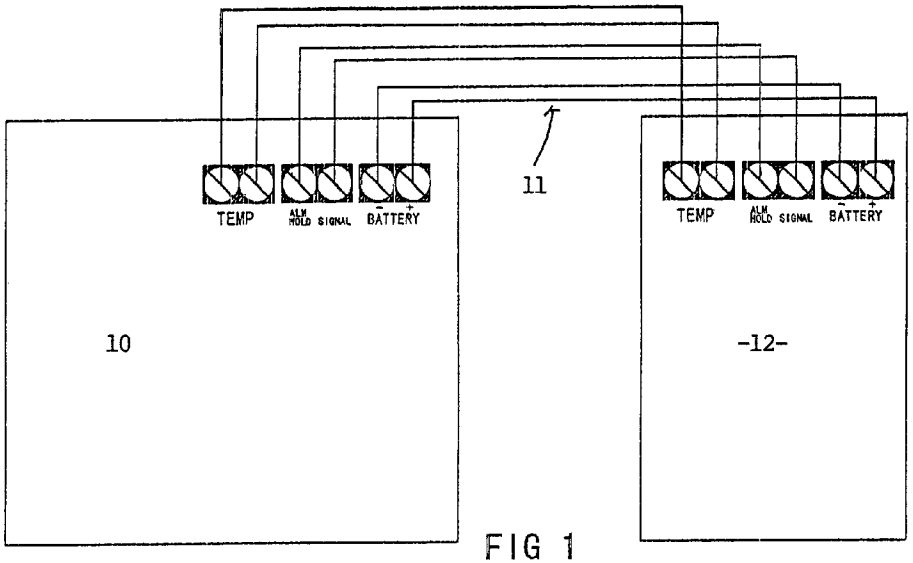
FIG 1 (PRIOR ART)
FIG. 1 is a schematic diagram of a conventional prior art control panel communicating via six wires with a remote keypad.

In FIG. 1 of the accompanying drawing there is depicted schematically a prior art conventional burglar alarm control panel 10 connected by a six-wire conductor 11 to a remote keypad 12. Two of these wires are for DC supply, two wires are for the data transmission and two wires are for tamper indication. As the remote keypad 12 can be quite some distance from the control panel 10, wiring can be expensive. Furthermore, it is necessary that the installation technician carefully connect the colour-coded wires to the correct terminals at both the control panel and remote keypad.

Figure 2:
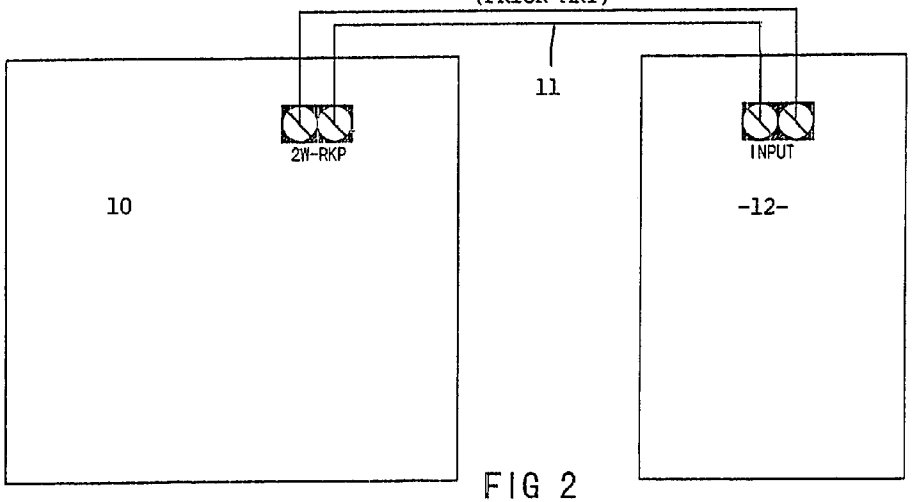
FIG. 2 is a schematic diagram of a control panel communicating via two wires with a remote keypad.
Figure 3:
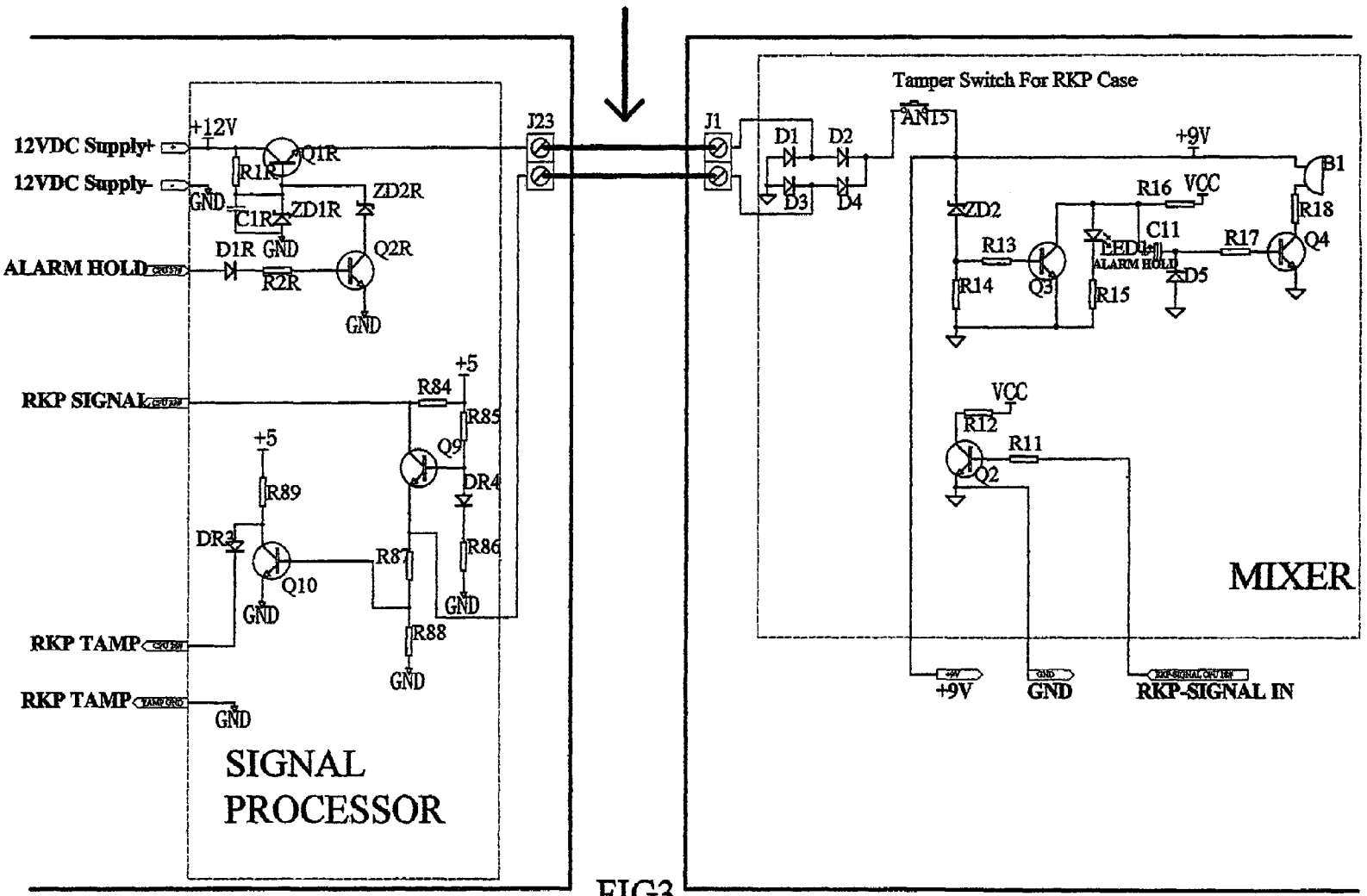
FIG. 3 is a schematic circuit diagram showing circuitry in the control panel's signal processor and the remote keypad.
Figure 4:
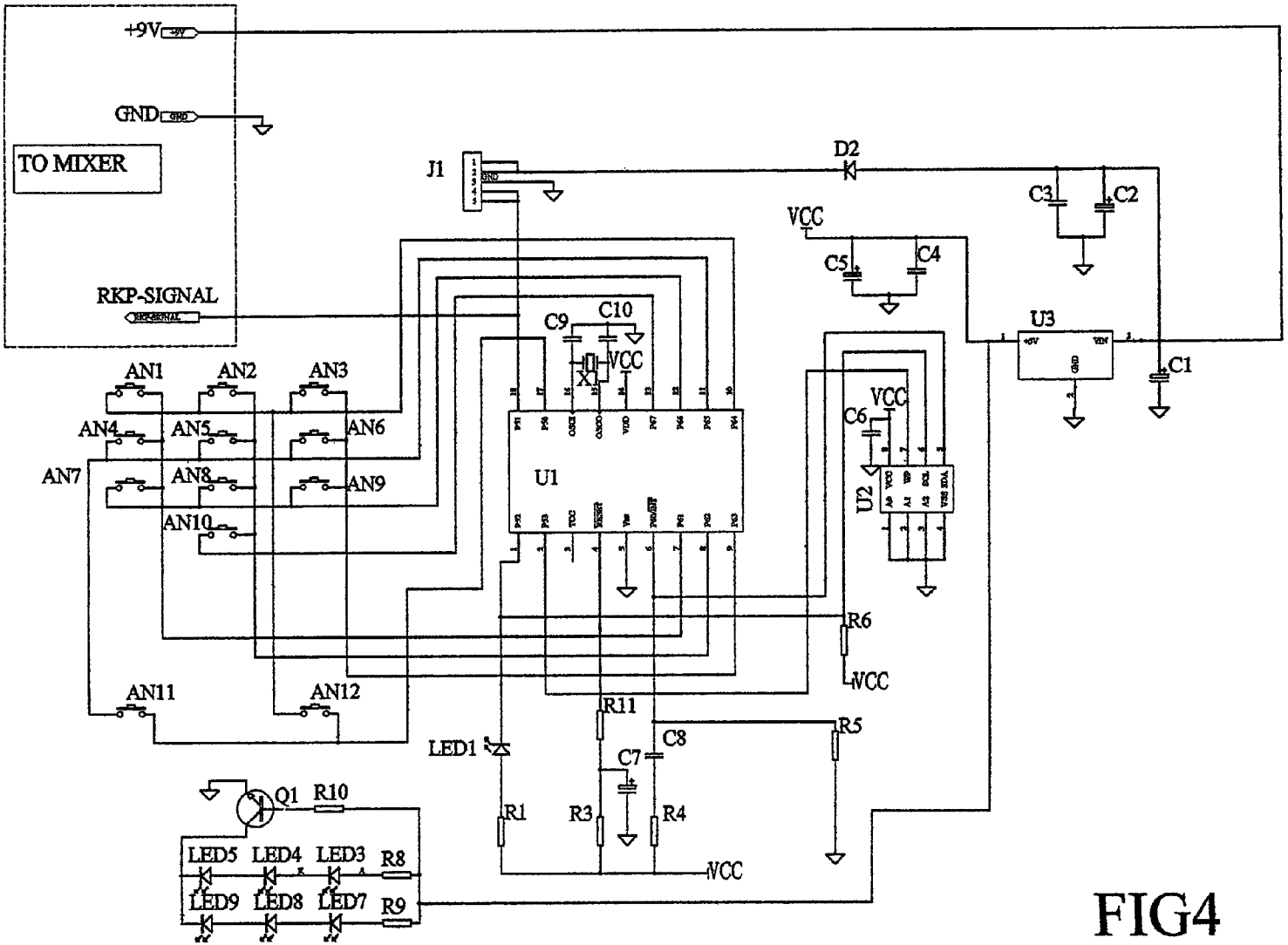
FIG. 4 is a schematic detailed circuit diagram of the remote keypad.
Figure 5:
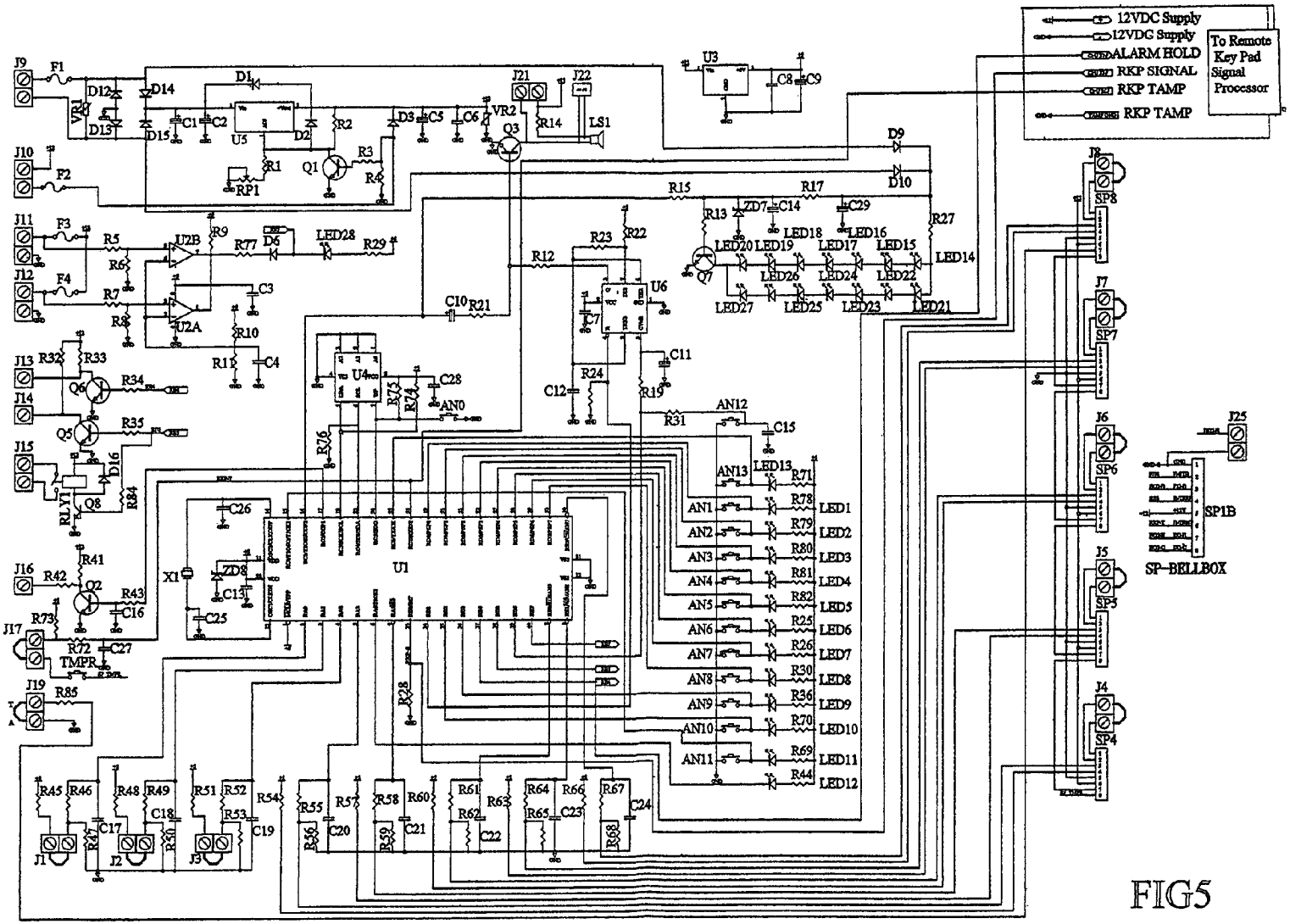
FIG. 5 is a schematic detailed circuit diagram of the control panel.

On the other hand, the arrangement depicted schematically in FIG. 2 requires only a two-conductor cable 11 between the control panel 10 and remote keypad 12. It is comparatively inexpensive and simple to install the system of FIG. 2 because the two-conductor cable can be installed at either polarity and there is no need to mess around with wires of different colour. This reduces installation errors. Furthermore, the two-conductor unit will perform all of the tasks of the six-wire conventional unit, by use of a signal processor and a mixer.

There is a mixer circuit 13 at the remote keypad 12 and a signal processor 14 at the control panel 10. The voltage and current in the two-conductor line 11 varies to indicate particular signals. The differing levels of voltage/current will be assigned to activate the functions for the control system or the remote unit through the signal processor and mixer. The processor 14 and mixer 13 both work to transmit and receive signals via the two-conductor cable. A reading of line voltage and/or current at the pre-assigned levels will result in correct functioning of the system. The signal processor is ordinarily to be built-in to the main control panel 10. The mixer will ordinarily be built-in or installed at the remote unit.

Different output signals from the control system through the signal processor will change the voltage and/or current in the two-conductor cable to different levels. As the mixer in the remote control unit at the other end of line receives different voltage or current levels, the mixer will inform the remote unit what to do.

Different output signals from the remote unit through the mixer will also change the current or voltage in the two-conductor cable to different levels. At the other end of the cable, the signal processor receives different current and voltage levels in the line and thereby informs the control system to function accordingly.

Current Level Activation from Mixer

Once the mixer 13 receives a high-level signal from the keypad 12 by activating any key on the keypad, the transistor Q2 works and draws high current by which the total current of the remote keypad is increased. This increasing current will turn the transistor Q9 off, then there is a high-level voltage at R84 sent to the SIGNAL port 33# of the CPU at the control panel.

Voltage Level Activation from Control Panel Signal Processor

After the signal processor of the control panel receives an alarm signal from the alarm hold signal port 37# of the CPU at the control panel, it creates a high-level voltage to the transistor Q2R. The voltage level of the two conductors 11 drops to a level whereupon Zener diode ZD2 stops and the transistor Q3 switches off to light up LED1 and the buzzer beeps.

Current Level Activation from Two Conductor's

If the two-conductor cable is cut, there will be no current drawn by the remote keypad. There will also be much less current passing through R87 and R88 and the transistor Q10 will switch off. As a result, there will be higher voltage at port 26# at the CPU of the control panel, thus indicating tampering.

The bridges D1, D2, D3 and D4 make for a two-conductor cable having no polarity.

The transistor Q1R is for voltage level changing and protection against short-circuiting of the two conductors.

It should be appreciated that modifications and alterations obvious to those of skilled in the art are not to be considered as beyond the scope of the present invention. For example, although the drawings and above description relate to the association between a remote keypad and the central processor, the invention is equally applicable to a remote bell box or siren sounder and its association with the central processor.

What is claimed is:

1. An alarm system comprising:

an alarm controller, a remote input/output device, a single cable extending from the alarm controller to the remote input/output device, the cable comprising only two conductors providing power to the remote input/output device, a signal processor at the controller monitoring and processing voltage and current fluctuations in the conductors and controlling functions of the alarm system, and a mixer at the remote input/output device operative to affect current and voltage at the two conductor cable, wherein the mixer applies said predefined voltage and current levels to the two conductors, and wherein both the signal processor and mixer transmit and receive signals via the two-conductor cable.

2. The alarm system of claim 1 wherein the predefined voltage and current levels correspond to different signal types.

3. The alarm system of claim 1 wherein the remote input/output device is a keypad.

* * * * *